US005405418A

United States Patent [19]

Ansarie et al.

[11] Patent Number: 5,405,418

[45] Date of Patent: Apr. 11, 1995

[54] FUEL ADDITIVE COMPOSITIONS CONTAINING AN ALIPHATIC AMINE, A POLYOLEFIN AND AN AROMATIC ESTER

[75] Inventors: Matthew H. Ansarie, San Francisco; Richard E. Cherpeck, Cotati; Randy G. Chevalier, Berkeley; Jeffrey J. Toman, Oakland, all of Calif.

[73] Assignee: Chevron Chemical Company, Sam Ramon, Calif.

[21] Appl. No.: 236,734

[22] Filed: May 2, 1994

[51] Int. Cl.[6] ..... C10L 1/18; C10L 1/22

[52] U.S. Cl. ..... 44/389; 44/398; 44/412

[58] Field of Search ..... 44/389, 398, 412

[56] References Cited

U.S. PATENT DOCUMENTS

| | | | |
|---|---|---|---|
| 2,937,933 | 5/1960 | Heisler et al. | 44/389 |
| 3,438,757 | 4/1969 | Honnen et al. | 44/58 |
| 3,502,451 | 3/1970 | Moore et al. | 44/58 |
| 3,660,056 | 2/1972 | Dorsch | 44/398 |
| 3,700,598 | 10/1972 | Plonsker et al. | 252/50 |
| 3,756,793 | 9/1973 | Robinson | 44/62 |
| 4,125,382 | 11/1978 | O'Brien et al. | 44/389 |
| 4,173,456 | 11/1979 | Scheule et al. | 44/62 |
| 4,357,148 | 11/1982 | Graiff | 44/62 |
| 4,832,702 | 5/1989 | Kummer et al. | 44/62 |
| 4,877,416 | 10/1989 | Campbell | 44/62 |
| 5,004,478 | 4/1991 | Vogel et al. | 44/398 |
| 5,089,028 | 2/1992 | Abramo et al. | 44/347 |
| 5,242,469 | 9/1993 | Sakakibara et al. | 44/347 |
| 5,296,003 | 3/1994 | Cherpeck | 44/398 |

FOREIGN PATENT DOCUMENTS

| | | | |
|---|---|---|---|
| 0356726 | 3/1990 | European Pat. Off. | C10L 1/18 |
| 0382159 | 8/1990 | European Pat. Off. | C10L 1/18 |
| 9215656 | 9/1992 | WIPO | C10L 1/14 |

*Primary Examiner*—Jacqueline V. Howard
*Attorney, Agent, or Firm*—C. J. Caroli

[57] ABSTRACT

A fuel additive composition comprising:

(a) a fuel-soluble aliphatic hydrocarbyl-substituted amine having at least one basic nitrogen atom wherein the hydrocarbyl group has a number average molecular weight of about 700 to 3,000;

(b) a polyolefin polymer of a $C_2$ to $C_6$ monoolefin, wherein the polymer has a number average molecular weight of about 350 to 3,000; and (c) an aromatic di- or tri-carboxylic acid ester of the formula:

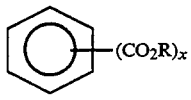

wherein R is an alkyl group of 4 to 20 carbon atoms, and x is 2 or 3.

57 Claims, No Drawings

FUEL ADDITIVE COMPOSITIONS CONTAINING AN ALIPHATIC AMINE, A POLYOLEFIN AND AN AROMATIC ESTER

BACKGROUND OF THE INVENTION

This invention relates to a fuel additive composition. More particularly, this invention relates to a fuel additive composition containing an aliphatic amine, a polyolefin and an aromatic ester.

It is well known that automobile engines tend to form deposits on the surface of engine components, such as carburetor ports, throttle bodies, fuel injectors, intake ports and intake valves, due to the oxidation and polymerization of hydrocarbon fuel. These deposits, even when present in relatively minor amounts, often cause noticeable driveability problems, such as stalling and poor acceleration. Moreover, engine deposits can significantly increase an automobile's fuel consumption and production of exhaust pollutants. Therefore, the development of effective fuel detergents or "deposit control" additives to prevent or control such deposits is of considerable importance and numerous such materials are known in the art.

For example, U.S. Pat. No. 3,438,757 to Honnen et al. discloses branched chain aliphatic hydrocarbon N-substituted amines and alkylene polyamines having a molecular weight in the range of about 425 to 10,000, preferably about 450 to 5,000, which are useful as detergents and dispersants in hydrocarbon liquid fuels for internal combustion engines.

U.S. Pat. No. 3,502,451 to Moore et al. discloses motor fuel compositions containing a polymer or copolymer of a $C_2$ to $C_6$ unsaturated hydrocarbon or the corresponding hydrogenated polymer or copolymer, wherein the polymer or copolymer has a molecular weight in the range of about 500 to 3,500. This patent further teaches that polyolefin polymers of propylene and butylene are particularly preferred.

U.S. Pat. No. 3,700,598 to Plonsker et al. discloses lubricating oil and fuel compositions containing a small amount of an N-hydrocarbyl-substituted nitrilotris ethylamine, wherein the hydrocarbyl group is preferably a polyolefin group having a molecular weight of about 300 to 20,000, preferably from 500 to 2,000. This patent further teaches that fuel compositions containing this additive will preferably also contain a small amount of a mineral oil and/or a synthetic olefin oligomer having an average molecular weight of about 300 to 2,000.

U.S. Pat. No. 3,756,793 to Robinson discloses a fuel composition containing minor amounts of (A) a polyamine which is the reaction product of a halohydrocarbon having an average molecular weight between 600 to 2500 and an alkylene polyamine, and (B) an organic substance having a viscosity between 20 and 2500 cs. at 20° C. This patent further discloses that a wide variety of compounds are suitable as the organic substance, including polyamines, amides, and esters or mixtures of esters, such as aliphatic diesters of dibasic aliphatic carboxylic acids. Preferred materials for use as the organic substance are described in this patent as polymers or copolymers having an average molecular weight of 300 to 5,000 which are selected from hydrocarbons, substituted hydrocarbons containing oxygen and substituted hydrocarbons containing oxygen and nitrogen. Most preferred polymeric compounds are described in this patent as polyalkylene oxides and polyether glycols.

U.S. Pat. No. 4,173,456 to Scheule et al. discloses a fuel additive composition comprising (A) a hydrocarbon-soluble acylated poly(alkyleneamine) and (B) a normally liquid hydrocarbon-soluble polymer of a $C_2$ to $C_6$ olefin, wherein the polymer has an average molecular weight of about 400 to 3,000.

U.S. Pat. No. 4,357,148 to Graiff discloses a motor fuel composition containing an octane requirement increase-inhibiting amount of (a) an oil soluble aliphatic polyamine containing at least one olefinic polymer chain and a molecular weight of about 600 to 10,000 and (b) a polymer and/or copolymer of a monoolefin having 2 to 6 carbon atoms, wherein the polymer has a number average molecular weight of about 500 to 1500.

U.S. Pat. No. 4,832,702 to Kummer et al. discloses a fuel or lubricant composition containing one or more polybutyl or polyisobutylamines. This patent further discloses that, since, in fuel additives, about 50% by weight of the active substance can be replaced by polyisobutene without loss of efficiency, the addition of polyisobutene having a molecular weight of 300 to 2000, preferably from 500 to 1500, is particularly advantageous from the point of view of cost.

U.S. Pat. No. 5,004,478 to Vogel et al. discloses a motor fuel for internal combustion engines which contains an additive comprising (a) an amino- or amino-containing detergent and (b) a base oil which is a mixture of (1) a polyether based on propylene oxide or butylene oxide and having a molecular weight not less than 500, and (2) an ester of a monocarboxylic or polycarboxylic acid and an alkanol or polyol.

U.S. Pat. No. 5,089,028 to Abramo et al. discloses a fuel composition containing an additive which comprises the combination of (1) a polyalkenyl succinimide, (2) a polyalkylene polymer, such as polyisobutylene or polypropylene, (3) an ester of an aliphatic or aromatic carboxylic acid, and (4) a polyether, such as polybutylene oxide, polypropylene or a polybutylene/polypropylene copolymer. The additive may also contain an optional amount of a mineral oil or a synthetic oil.

U.S. Pat. No. 5,242,469 to Sakakibara et al. discloses a gasoline additive composition comprising (A) a monoester, diester or polyolester, and (B) a dispersant selected from (1) a monosuccinimide, (2) a bis-succinimide, (3) an alkylamine having a polyolefin polymer as an alkyl group and an average molecular weight of 500–5,000, and (4) a benzylamine derivative having an average molecular weight of 500–5,000. The additive composition may additionally contain a polyoxyalkylene glycol or its derivative and/or a lubricant oil fraction.

PCT International Patent Application Publication No. WO 92/15656, published Sep. 17, 1992, discloses an additive for gasoline petroleum fuel comprising (A) an oil soluble polyolefin polyamine containing at least one olefinic polymer chain, and (B) a polymer of a $C_2$ to $C_6$ monoolefin, wherein the polymer has a number average molecular weight of up to 2,000, and preferably up to 500. This document further discloses that the additive may be used in combination with other additives, including plasticizer esters, such as adipates and mixtures thereof, scavengers, antioxidants, ignition improvers, and metal deactivators.

European Patent Application Publication No. 0,382,159 A1, published Aug. 16, 1990, discloses a liquid hydrocarbon fuel for an internal combustion engine containing a deposit removing and residue inhibiting amount of at least one $C_1$ to $C_4$ dialkyl ester of a $C_4$ to $C_6$ aliphatic dibasic acid.

European Patent Application Publication No. 0,356,726 A2, published Mar. 7, 1990 discloses fuel compositions containing esters of aromatic di-, tri-, or tetracarboxylic acids with long-chain aliphatic alcohols or ether alcohols, wherein the alcohols are produced by the hydroformylation of branched olefins, and wherein the total carbon number of the esters is at least 36 carbon atoms and the molecular weight of the esters is 550 to 1,500, preferably 600 to 1,200.

U.S. Pat. No. 4,877,416 to Campbell discloses a fuel composition which contains (A) a hydrocarbyl-substituted amine or polyamine having an average molecular weight of about 750 to 10,000 and at least one basic nitrogen atom, and (B) a hydrocarbyl-terminated poly(oxyalkylene) monool having an average molecular weight of about 500 to 5,000.

It has now been discovered that the unique combination of an aliphatic hydrocarbyl-substituted amine, a polyolefin polymer and an aromatic di- or tri-carboxylic acid ester provides excellent valve sticking performance, while maintaining good control of engine deposits, especially intake valve deposits, when employed as a fuel additive composition for hydrocarbon fuels.

SUMMARY OF THE INVENTION

The present invention provides a novel fuel additive composition comprising:

(a) a fuel-soluble aliphatic hydrocarbyl-substituted amine having at least one basic nitrogen atom wherein the hydrocarbyl group has a number average molecular weight of about 700 to 3,000;

(b) a polyolefin polymer of a $C_2$ to $C_6$ monoolefin, wherein the polymer has a number average molecular weight of about 350 to 3,000; and (c) an aromatic di- or tri-carboxylic acid ester of the formula:

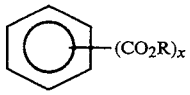

wherein R is an alkyl group of 4 to 20 carbon atoms, and x is 2 or 3.

The present invention further provides a fuel composition comprising a major amount of hydrocarbons boiling in the gasoline or diesel range and an effective detergent amount of the novel fuel additive composition described above.

The present invention is also concerned with a fuel concentrate comprising an inert stable oleophilic organic solvent boiling in the range of from about 150° F. to 400° F. and from about 10 to 70 weight percent of the fuel additive composition of the instant invention.

Among other factors, the present invention is based on the surprising discovery that the unique combination of an aliphatic amine, a polyolefin and an aromatic ester provides unexpectedly superior valve sticking performance when compared to the combination of aliphatic amine and either polyolefin or aromatic ester alone, while maintaining good control of engine deposits.

DETAILED DESCRIPTION OF THE INVENTION

As noted above, the fuel additive composition of the present invention contains an aliphatic hydrocarbyl-substituted amine, a polyolefin polymer, and an aromatic di- or tri-carboxylic acid ester. These compounds are described in detail below.

A. The Aliphatic Hydrocarbyl-Substituted Amine

The fuel-soluble aliphatic hydrocarbyl-substituted amine component of the present fuel additive composition is a straight or branched chain hydrocarbyl-substituted amine having at least one basic nitrogen atom wherein the hydrocarbyl group has a number average molecular weight of about 700 to 3,000. Typically, such aliphatic amines will be of sufficient molecular weight so as to be nonvolatile at normal engine intake valve operating temperatures, which are generally in the range of about 175° C. to 300°.

Preferably, the hydrocarbyl group will have a number average molecular weight in the range of about 750 to 2,200, and more preferably, in the range of about 900 to 1,500. The hydrocarbyl group will generally be branched chain.

When employing a branched-chain hydrocarbyl amine, the hydrocarbyl group is preferably derived from polymers of $C_2$ to $C_6$ olefins. Such branched-chain hydrocarbyl group will ordinarily be prepared by polymerizing olefins of from 2 to 6 carbon atoms (ethylene being copolymerized with another olefin so as to provide a branched-chain). The branched chain hydrocarbyl group will generally have at least 1 branch per 6 carbon atoms along the chain, preferably at least 1 branch per 4 carbon atoms along the chain and, more preferably, at least 1 branch per 2 carbon atoms along the chain. The preferred branched-chain hydrocarbyl groups are polypropylene and polyisobutylene. The branches will usually be of from 1 to 2 carbon atoms, preferably 1 carbon atom, that is, methyl. In general, the branched-chain hydrocarbyl group will contain from about 18 to about 214 carbon atoms, preferably from about 50 to about 157 carbon atoms.

In most instances, the branched-chain hydrocarbyl amines are not a pure single product, but rather a mixture of compounds having an average molecular weight. Usually, the range of molecular weights will be relatively narrow and peaked near the indicated molecular weight.

The amine component of the branched-chain hydrocarbyl amines may be derived from ammonia, a monoamine or a polyamine. The monoamine or polyamine component embodies a broad class of amines having from 1 to about 12 amine nitrogen atoms and from 1 to 40 carbon atoms with a carbon to nitrogen ratio between about 1:1 and 10:1. Generally, the monoamine will contain from i to about 40 carbon atoms and the polyamine will contain from 2 to about 12 amine nitrogen atoms and from 2 to about 40 carbon atoms. In most instances, the amine component is not a pure single product, but rather a mixture of compounds having a major quantity of the designated amine. For the more complicated polyamines, the compositions will be a mixture of amines having as the major product the compound indicated and having minor amounts of analogous compounds. Suitable monoamines and polyamines are described more fully below.

When the amine component is a polyamine, it will preferably be a polyalkylene polyamine, including alkylenediamine. Preferably, the alkylene group will contain from 2 to 6 carbon atoms, more preferably from 2 to 3 carbon atoms. Examples of such polyamines include ethylene diamine, diethylene triamine, triethylene tetramine and tetraethylene pentamine. Preferred polyamines are ethylene diamine and diethylene triamine.

Particularly preferred branched-chain hydrocarbyl amines include polyisobutenyl ethylene diamine and polyisobutyl amine, wherein the polyisobutyl group is substantially saturated and the amine moiety is derived from ammonia.

The aliphatic hydrocarbyl amines employed in the fuel additive composition of the invention are prepared by conventional procedures known in the art. Such aliphatic hydrocarbyl amines and their preparations are described in detail in U.S. Pat. Nos. 3,438,757; 3,565,804; 3,574,576; 3,848,056; 3,960,515; and 4,832,702, the disclosures of which are incorporated herein by reference.

Typically, the hydrocarbyl-substituted amines employed in this invention are prepared by reacting a hydrocarbyl halide, such as a hydrocarbyl chloride, with ammonia or a primary or secondary amine to produce the hydrocarbyl-substituted amine.

As noted above, the amine component of the presently employed hydrocarbyl-substituted amine is derived from a nitrogen-containing compound selected from ammonia, a monoamine having from 1 to 40 carbon atoms, and a polyamine having from 2 to about 12 amine nitrogen atoms and from 2 to about 40 carbon atoms. The nitrogen-containing compound is reacted with a hydrocarbyl halide to produce the hydrocarbyl-substituted amine fuel additive finding use within the scope of the present invention. The amine component provides a hydrocarbyl amine reaction product with, on average, at least about one basic nitrogen atom per product molecule, i.e., a nitrogen atom titratable by a strong acid.

Preferably, the amine component is derived from a polyamine having from 2 to about 12 amine nitrogen atoms and from 2 to about 40 carbon atoms. The polyamine preferably has a carbon-to-nitrogen ratio of from about 1:1 to 10:1.

The polyamine may be substituted with substituents selected from (A) hydrogen, (B) hydrocarbyl groups of from 1 to about 10 carbon atoms, (C) acyl groups of from 2 to about 10 carbon atoms, and (D) monoketo, monohydroxy, mononitro, monocyano, lower alkyl and lower alkoxy derivatives of (B) and (C). "Lower" as used in terms like lower alkyl or lower alkoxy, means a group containing from 1 to about 6 carbon atoms. At least one of the substituents on one of the basic nitrogen atoms of the polyamine is hydrogen, e.g., at least one of the basic nitrogen atoms of the polyamine is a primary or secondary amino nitrogen.

Hydrocarbyl, as used in describing the polyamine moiety on the aliphatic amine employed in this invention, denotes an organic radical composed of carbon and hydrogen which may be aliphatic, alicyclic, aromatic or combinations thereof, e.g., aralkyl. Preferably, the hydrocarbyl group will be relatively free of aliphatic unsaturation, i.e., ethylenic and acetylenic, particularly acetylenic unsaturation. The substituted polyamines of the present invention are generally, but not necessarily, N-substituted polyamines. Exemplary hydrocarbyl groups and substituted hydrocarbyl groups include alkyls such as methyl, ethyl, propyl, butyl, isobutyl, pentyl, hexyl, octyl, etc., alkenyls such as propenyl, isobutenyl, hexenyl, octenyl, etc., hydroxyalkyls, such as 2-hydroxyethyl, 3-hydroxypropyl, hydroxy-isopropyl, 4-hydroxybutyl, etc., ketoalkyls, such as 2-ketopropyl, 6-ketooctyl, etc., alkoxy and lower alkenoxy alkyls, such as ethoxyethyl, ethoxypropyl, propoxyethyl, propoxypropyl, diethyleneoxymethyl, triethyleneoxyethyl, tetraethyleneoxyethyl, diethyleneoxyhexyl, etc. The aforementioned acyl groups (C) are such as propionyl, acetyl, etc. The more preferred substituents are hydrogen, $C_1$-$C_6$ alkyls and $C_1$-$C_6$ hydroxyalkyls.

In a substituted polyamine, the substituents are found at any atom capable of receiving them. The substituted atoms, e.g., substituted nitrogen atoms, are generally geometrically unequivalent, and consequently the substituted amines finding use in the present invention can be mixtures of mono- and poly-substituted polyamines with substituent groups situated at equivalent and/or unequivalent atoms.

The more preferred polyamine finding use within the scope of the present invention is a polyalkylene polyamine, including alkylene diamine, and including substituted polyamines, e.g., alkyl and hydroxyalkyl-substituted polyalkylene polyamine. Preferably, the alkylene group contains from 2 to 6 carbon atoms, there being preferably from 2 to 3 carbon atoms between the nitrogen atoms. Such groups are exemplified by ethylene, 1,2-propylene, 2,2-dimethylpropylene, trimethylene, 1,3,2-hydroxypropylene, etc. Examples of such polyamines include ethylene diamine, diethylene triamine, di(trimethylene) triamine, dipropylene triamine, triethylene tetraamine, tripropylene tetraamine, tetraethylene pentamine, and pentaethylene hexamine. Such amines encompass isomers such as branched-chain polyamines and previously-mentioned substituted polyamines, including hydroxy- and hydrocarbyl-substituted polyamines. Among the polyalkylene polyamines, those containing 2–12 amino nitrogen atoms and 2–24 carbon atoms are especially preferred, and the C2-$C_3$ alkylene polyamines are most preferred, that is, ethylene diamine, polyethylene polyamine, propylene diamine and polypropylene polyamine, and in particular, the lower polyalkylene polyamines, e.g., ethylene diamine, dipropylene triamine, etc. Particularly preferred polyalkylene polyamines are ethylene diamine and diethylene triamine.

The amine component of the presently employed aliphatic amine fuel additive also may be derived from heterocyclic polyamines, heterocyclic substituted amines and substituted heterocyclic compounds, wherein the heterocycle comprises one or more 5–6 membered rings containing oxygen and/or nitrogen. Such heterocyclic rings may be saturated or unsaturated and substituted with groups selected from the aforementioned (A), (B), (C) and (D). The heterocyclic compounds are exemplified by piperazines, such as 2-methylpiperazine, N-(2-hydroxyethyl)-piperazine, 1,2-bis-(N-piperazinyl)ethane and N,N'-bis(N-piperazinyl)-piperazine, 2-methylimidazoline, 3-aminopiperidine, 3-aminopyridine, N-(3-aminopropyl)morpholine, etc. Among the heterocyclic compounds, the piperazines are preferred.

Typical polyamines that can be used to form the aliphatic amine additives employed in this invention by reaction with a hydrocarbyl halide include the following: ethylene diamine, 1,2-propylene diamine, 1,3-propylene diamine, diethylene triamine, triethylene tetramine, hexamethylene diamine, tetraethylene pentamine, dimethylaminopropylene diamine, N-(beta-aminoethyl)piperazine, N-(beta-aminoethyl)piperidine, 3-amino-N-ethylpiperidine, N-(beta-aminoethyl) morpholine, N,N'-di(beta-aminoethyl)piperazine, N,N'-di(beta-aminoethyl)imidazolidone-2, N-(beta-cyanoethyl) ethane-1,2-diamine, 1-amino-3,6,9-triazaoctadecane, 1-amino-3,6-diaza-9-oxadecane, N-(beta-aminoethyl) diethanolamine, N'acetylmethyl-N-(beta-aminoethyl) ethane-1,2-diamine, N-acetonyl-1,2-propanediamine, N-(beta-nitroethyl)-1,3-propane diamine, 1,3-dimethyl-5(beta-aminoethyl)hexahydrotriazine, N-(beta-aminoethyl)-hexahydrotriazine, 5-(beta-aminoethyl)-1,3,5-dioxazine, 2-(2-aminoethylamino)ethanol, and 2-[2-(2-aminoethylamino) ethylamino]ethanol.

Alternatively, the amine component of the presently employed aliphatic hydrocarbyl-substituted amine may be derived from an amine having the formula:

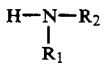

wherein $R_1$ and $R_2$ are independently selected from the group consisting of hydrogen and hydrocarbyl of 1 to about 20 carbon atoms and, when taken together, $R_1$ and $R_2$ may form one or more 5- or 6-membered rings containing up to about 20 carbon atoms. Preferably, $R_1$ is hydrogen and $R_2$ is a hydrocarbyl group having 1 to about 10 carbon atoms. More preferably, $R_1$ and $R_2$ are hydrogen. The hydrocarbyl groups may be straight-chain or branched and may be aliphatic, alicyclic, aromatic or combinations thereof. The hydrocarbyl groups may also contain one or more oxygen atoms.

An amine of the above formula is defined as a "secondary amine" when both $R_1$ and $R_2$ are hydrocarbyl. When $R_1$ is hydrogen and $R_2$ is hydrocarbyl, the amine is defined as a "primary amine"; and when both $R_1$ and $R_2$ are hydrogen, the amine is ammonia.

Primary amines useful in preparing the aliphatic hydrocarbyl-substituted amine fuel additives of the present invention contain 1 nitrogen atom and 1 to about 20 carbon atoms, preferably 1 to 10 carbon atoms. The primary amine may also contain one or more oxygen atoms.

Preferably, the hydrocarbyl group of the primary amine is methyl, ethyl, propyl, butyl, pentyl, hexyl, octyl, 2-hydroxyethyl or 2-methoxyethyl. More preferably, the hydrocarbyl group is methyl, ethyl or propyl.

Typical primary amines are exemplified by N-methylamine, N-ethylamine, N-n-propylamine, N-isopropylamine, N-n-butylamine, N-isobutylamine, N-sec-butylamine, N-tert-butylamine, N-n-pentylamine, N-cyclopentylamine, N-n-hexylamine, N-cyclohexylamine, N-octylamine, N-decylamine, N-dodecylamine, N-octadecylamine, N-benzylamine, N-(2-phenylethyl-)amine, 2-aminoethanol, 3-amino-l-proponal, 2-(2-aminoethoxy)ethanol, N-(2-methoxyethyl)amine, N-(2-ethoxyethyl)amine, and the like. Preferred primary amines are N-methylamine, N-ethylamine and N-n-propylamine.

The amine component of the presently employed aliphatic hydrocarbyl-substituted amine fuel additive may also be derived from a secondary amine. The hydrocarbyl groups of the secondary amine may be the same or different and will generally contain 1 to about 20 carbon atoms, preferably 1 to about 10 carbon atoms. One or both of the hydrocarbyl groups may also contain one or more oxygen atoms.

Preferably, the hydrocarbyl groups of the secondary amine are independently selected from the group consisting of methyl, ethyl, propyl, butyl, pentyl, hexyl, 2-hydroxyethyl and 2-methoxyethyl. More preferably, the hydrocarbyl groups are methyl, ethyl or propyl.

Typical secondary amines which may be used in this invention include N,N-dimethylamine, N,N-diethylamine, N,N-di-n-propylamine, N,N-diisopropylamine, N,N-di-n-butylamine, N,N-di-sec-butylamine, N,N-di-n-pentylamine, N,N-di-n-hexylamine, N,N-dicyclohexylamine, N,N-dioctylamine, N-ethyl-N-methylamine, N-methyl-N-n-propylamine, N-n-butyl-N-methylamine, N-methyl-N-octylamine, N-ethyl-N-isopropylamine, N-ethyl-N-octylamine, N,N-di(2-hydroxyethyl)amine, N,N-di(3-hydroxypropyl)amine, N,N-di(ethoxyethyl)amine, N,N-di(propoxyethyl)amine, and the like. Preferred secondary amines are N,N-dimethylamine, N,N-diethylamine and N,N-di-n-propylamine.

Cyclic secondary amines may also be employed to form the aliphatic amine additives of this invention. In such cyclic compounds, $R_1$ and $R_2$ of the formula hereinabove, when taken together, form one or more 5- or 6-membered rings containing up to about 20 carbon atoms. The ring containing the amine nitrogen atom is generally saturated, but may be fused to one or more saturated or unsaturated rings. The rings may be substituted with hydrocarbyl groups of from 1 to about 10 carbon atoms and may contain one or more oxygen atoms.

Suitable cyclic secondary amines include piperidine, 4-methylpiperidine, pyrrolidine, morpholine, 2,6-dimethylmorpholine, and the like.

In many instances, the amine component is not a single compound but a mixture in which one or several compounds predominate with the average composition indicated. For example, tetraethylene pentamine prepared by the polymerization of aziridine or the reaction of dichloroethylene and ammonia will have both lower and higher amine members, e.g., triethylene tetraamine, substituted piperazines and pentaethylene hexamine, but the composition will be mainly tetraethylene pentamine and the empirical formula of the total amine composition will closely approximate that of tetraethylene pentamine. Finally, in preparing the compounds of this invention using a polyamine, where the various nitrogen atoms of the polyamine are not geometrically equivalent, several substitutional isomers are possible and are encompassed within the final product. Methods of preparation of amines and their reactions are detailed in Sidgewick's "The Organic Chemistry of Nitrogen", Clarendon Press, Oxford, 1966; Noller's "Chemistry of Organic Compounds" Saunders Philadelphia, 2nd Ed , 1957; and Kirk-Othmer's "Encyclopedia of Chemical Technology", 2nd Ed., especially Volume 2, pp. 99–116.

Preferred aliphatic hydrocarbyl-substituted amines suitable for use in the present invention are hydrocarbyl-substituted polyalkylene polyamines having the formula:

$$R_3NH—(R_4—NH)_n—H$$

wherein $R_3$ is a hydrocarbyl group having a number average molecular weight of about 700 to 3,000; $R_4$ is alkylene of from 2 to 6 carbon atoms; and n is an integer of from 0 to about 10.

Preferably, $R_3$ is a hydrocarbyl group having a number average molecular weight of about 750 to 2,200, more preferably, from about 900 to 1,500. Preferably, $R_4$ is alkylene of from 2 to 3 carbon atoms and n is preferably an integer of from 1 to 6.

B. The Polyolefin Polymer

The polyolefin polymer component of the present fuel additive composition is a polyolefin polymer of a $C_2$ to $C_6$ monoolefin, wherein the polyolefin polymer has a number average molecular weight of about 350 to 3,000. The polyolefin polymer may be a homopolymer or a copolymer.

Block copolymers are also suitable for use in this invention.

In general, the polyolefin polymer will have a number average molecular weight of about 350 to 3,000, preferably about 350 to 1,500, and more preferably from about 350 to 500. Particularly preferred polyolefin polymers will have a number average molecular weight of about 375 to 450.

The polyolefin polymers employed in the present invention are generally polyolefins which are polymers or copolymers of mono-olefins, particularly 1-mono-olefins, such as ethylene, propylene, butylene, and the like. Preferably, the mono-olefin employed will have 2 to about 4 carbon atoms, and more preferably, about 3 to 4 carbon atoms. More preferred mono-olefins include propylene and butylene, particularly isobutylene. Polyolefins prepared from such mono-olefins include polypropylene and polybutene, especially polyisobutene.

The polyisobutenes which are suitable for use in the present invention include polyisobutenes which comprise at least about 20% of the more reactive methylvinylidene isomer, preferably at least 50% and more preferably at least 70%. Suitable polyisobutenes include those prepared using $BF_3$ catalysts. The preparation of such polyisobutenes in which the methylvinylidene isomer comprises a high percentage of the total composition is described in U.S. Pat. Nos. 4,152,499 and 4,605,808.

Examples of suitable polyisobutenes having a high alkylvinylidene content include Ultravis 30, a polyisobutene having a number average molecular weight of about 1300 and a methylvinylidene content of about 74%, and Ultravis 10, a 950 molecular weight polyisobutene having a methylvinylidene content of about 76%, both available from British Petroleum.

Preferred polyisobutenes include those having a number average molecular weight of about 375 to 450, such as Parapol 450, a polyisobutene having a number average molecular weight of about 420, available from Exxon Chemical Company.

C. The Aromatic Ester

The aromatic ester component of the present fuel additive composition is an aromatic di- or tri-carboxylic acid ester having the formula:

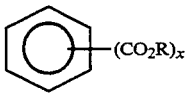

wherein R is an alkyl group of 4 to 20 carbon atoms, and x is 2 or 3.

The alkyl group R may be straight chain or branched chain, and is preferably branched chain. Preferably, R is an alkyl group of 6 to 16 carbon atoms, more preferably from 8 to 13 carbon atoms. Preferably, x is 2, that is, the aromatic ester is preferably an aromatic di-carboxylic acid ester.

The aromatic di- or tri-carboxylic acid esters are either known compounds or are conveniently prepared from known compounds using conventional procedures. Typically, the aromatic esters are prepared by reacting an aromatic di- or tri-carboxylic acid with a straight or branched chain aliphatic alcohol having 4 to 20 carbon atoms.

Suitable aromatic di- or tri-carboxylic acid esters finding use in the present invention include phthalic acid esters, isophthalic acid esters, terephthalic acid esters, trimellitic acid esters, and the like. Preferred aromatic esters are phthalate, isophthalate and terephthalate esters. More preferably, the aromatic ester is a phthalate ester. A particularly preferred aromatic ester is di-isodecyl phthalate.

A preferred fuel additive composition within the scope of the present invention is one wherein component (a) is a polyisobutenyl amine, wherein the amine moiety is derived from ethylene diamine or diethylene triamine, component (b) is polyisobutene, and component (c) is a phthalate ester.

FUEL COMPOSITIONS

The fuel additive composition of the present invention will generally be employed in a hydrocarbon distillate fuel boiling in the gasoline or diesel range. The proper concentration of this additive composition necessary in order to achieve the desired detergency and dispersancy varies depending upon the type of fuel employed, the presence of other detergents, dispersants and other additives, etc. Generally, however, from 150 to 7500 weight ppm, preferably from 300 to 2500 ppm, of the present additive composition per part of base fuel is needed to achieve the best results.

In terms of individual components, fuel compositions containing the additive compositions of the invention will generally contain about 50 to 500 ppm by weight of the aliphatic amine, about 50 to 1,000 ppm by weight of the polyolefin, and about 50 to 1,000 ppm by weight of the aromatic ester. The ratio of aliphatic amine to polyolefin to aromatic ester (amine:polyolefin:ester) will generally be in the range of about 1:0.5 to 10:0.5 to 10, preferably about 1:1 to 5:1 to 5, and more preferably about 1:1:1.

The deposit control fuel additive composition may be formulated as a concentrate, using an inert stable oleophilic (i.e., dissolves in gasoline) organic solvent boiling in the range of about 150° F. to 400° F. (about 65° C. to 205° C.). Preferably, an aliphatic or an aromatic hydrocarbon solvent is used, such as benzene, toluene, xylene or higher-boiling aromatics or aromatic thinners. Aliphatic alcohols of about 3 to 8 carbon atoms, such as isopropanol, isobutylcarbinol, n-butanol and the like, in combination with hydrocarbon solvents are also suitable for use with the detergent-dispersant additive. In the concentrate, the amount of the present additive composition will be ordinarily at least 10% by weight and generally not exceed 90% by weight, preferably 40 to 85 weight percent and most preferably from 50 to 80 weight percent.

In gasoline fuels, other fuel additives may be employed with the additives of the present invention, including, for example, oxygenates, such as t-butyl methyl ether, antiknock agents, such as methylcyclopentadienyl manganese tricarbonyl, and other dispersants/detergents, such as various hydrocarbyl amines, hydrocarbyl poly(oxyalkylene) amines, or succinimides. Also included may be lead scavengers, such as aryl halides, e.g., dichlorobenzene, or alkyl halides, e.g., ethylene dibromide. Additionally, antioxidants, metal deactivators, pour point depressants, corrosion inhibitors and demulsifiers may be present. The gasoline fuels may also contain amounts of other fuels such as, for example, methanol.

Additional fuel additives which may be present include fuel injector inhibitors, low molecular weight fuel injector detergents, and carburetor detergents, such as a low molecular weight hydrocarbyl amine, including polyamines, having a molecular weight below 700, such as oleyl amine or a low molecular weight polyisobutenyl ethylene diamine, for example, where the polyisobutenyl group has a number average molecular weight of about 420.

In diesel fuels, other well-known additives can be employed, such as pour point depressants, flow improverse, cetane improvers, and the like. The diesel fuels can also include other fuels such as, for example, methanol.

A fuel-soluble, nonvolatile carrier fluid or oil may also be used with the fuel additive composition of this invention. The carrier fluid is a chemically inert hydrocarbon-soluble liquid vehicle which substantially increases the nonvolatile residue (NVR), or solvent-free liquid fraction of the fuel additive composition while not overwhelmingly contributing to octane requirement increase. The carrier fluid may be a natural or synthetic oil, such as mineral oil or refined petroleum oils.

These carrier fluids are believed to act as a carrier for the fuel additives of the present invention and to assist in removing and retarding deposits. The carrier fluid may also exhibit synergistic deposit control properties when used in combination with a fuel additive composition of this invention.

The carrier fluids are typically employed in amounts ranging from about 50 to about 2000 ppm by weight of the hydrocarbon fuel, preferably from 100 to 800 ppm of the fuel. Preferably, the ratio of carrier fluid to deposit control additive will range from about 0.5:1 to about 10:1, more preferably from 1:1 to 4:1.

When employed in a fuel concentrate, carrier fluids will generally be present in amounts ranging from about 10 to about 60 weight percent, preferably from 20 to 40 weight percent.

The following examples are presented to illustrate specific embodiments of this invention and are not to be construed in any way as limiting the scope of the invention.

EXAMPLES

Example A1

An engine test was carried out using commercial regular unleaded gasoline to measure deposits on intake valves and combustion chambers using this fuel. The test engine was a 2.3 liter, Port Fuel Injected (PFI), dual spark plug, four-cylinder engine manufactured by Ford Motor Company. Major dimensions are set forth in Table 1.

TABLE 1

| Engine Dimensions | |
|---|---|
| Bore | 96 mm |
| Stroke | 79.3 mm |
| Displacement | 2.3 liter |
| Compression Ratio | 10.3:1 |

The test engine was operated for 100 hours (24 hours a day) on a prescribed lead and speed schedule specified by the Coordinating Research Council as a standard condition for Intake Valve Deposit testing. The cycle for engine operation is set forth in Table 2.

TABLE 2

| Engine Operating Cycle | | | | |
|---|---|---|---|---|
| Step | Mode | Time in Mode [minute][1] | Engine Speed [RPM] | Manifold Pressure [mm Hg Abs.] |
| 1 | Idle | 4.5 | 2000 | 223 |
| 2 | Load | 8.5 | 2800 | 522 |

[1]Each step includes a 30-second transition ramp.

At the end of each test run, the intake valves were removed, washed with hexane, and weighed. The previously determined weights of the clean valves were subtracted from the weights of the valves at the end of the run. The difference between the two weights is the weight of the intake valve deposit (IVD). Also, for each cylinder, the piston top and the mating surface of the cylinder head were scraped and the deposit removed was weighed as the measure of the combustion chamber deposit (CCD). The results are set forth in Table 3 below.

Example A2

A sample fuel composition A2 was prepared by adding:

(1) 125 ppm by weight di-isodecyl phthalate ester, and (2) 125 ppma (parts per million actives) by weight of a hydrocarbyl amine having a 1300 MW polyisobutenyl moiety and an ethylene diamine moiety to the gasoline of Example A1.

The same experiment as in Example A1 was carried out using this fuel composition, and the results are shown in Table 3 below.

Example A3

A sample fuel composition A3 was prepared by adding:

(1) 125 ppm by weight of 420 number average molecular weight polyisobutene, and (2) 125 ppma by weight of a hydrocarbyl amine having a 1300 MW polyisobutenyl moiety and an ethylene diamine moiety to the gasoline of Example A1.

The same experiment as in Example A1 was carried out using this fuel composition, and the results are shown in Table 3 below.

Example A4

A sample fuel composition A4 was prepared by adding:

(1) 125 ppm by weight of 420 number average molecular weight polyisobutene; and (2) 125 ppm by weight di-isodecyl phthalate ester, and (3) 125 ppma by weight of a hydrocarbyl amine having a 1300 MW polyisobutenyl moiety and an ethylene diamine moiety to the gasoline of Example A1.

The same experiment as in Example A1 was carried out using this fuel composition, and the results are shown in Table 3 below.

TABLE 3

| Ford 2.3 Liter Endine Test Results | | |
|---|---|---|
| | Average Weight per Cylinder | |
| Test Fuel Detergent Package | IVD (mg) | CCD (mg) |
| Base Fuel A1 | 419 | 949 |
| Fuel Composition A2 | 715 | 1340 |
| Fuel Composition A3 | 580 | 1201 |
| Fuel Composition A4 | 577 | 1485 |

The results in Table 3 show that the fuel additive composition of the present invention (Example A4) exhibits very good intake valve deposit control performance, equivalent to or better than the two-component additive compositions of Examples A2 and A3, while maintaining a low level of combustion chamber deposits.

Example B1

An engine test was carried out using Phillips-J gasoline, an industry testing fuel, to evaluate its tendency to cause intake valve stickiness. The test engine was a 2-cylinder, 4-stroke, overhead-cam, liquid-cooled Honda generator model ES6500. Major specifications for the Honda generator are set forth in Table 4.

TABLE 4

| Engine Specifications | |
|---|---|
| Bore | 56 mm |
| Stroke | 68 mm |
| Displacement | 0.369 liter |
| Maximum Horsepower | 12.2 HP @ 3600 rpm |

The test procedure includes 80 hours of continuous operation on the test fuel. The test cycle consists of two 2-hour stages. The stage conditions are set forth in Table 5.

TABLE 5

| Engine Operating Cycle | | | |
|---|---|---|---|
| Stage | Time in Stage [hour] | Engine Speed [RPM] | Generator Load [watt] |
| 1 | 2.0 | 3000 | 1500 |
| 2 | 2.0 | 3000 | 2500 |

[1]Each step includes a short transition ramp.

During the test, the generator speed was maintained by automatic control of the engine throttle. A bank of incandescent bulbs with various electrical lead ratings were used to induce the lead on the generator.

At the end of each test, the engine was disassembled and the cylinder head, with valve springs and seals removed, and with the valves open, was stored in a freezer at 5° F. overnight. The stickiness of the valves were determined by using a lead cell to measure the force required to close each valve at an approximate speed of 1.22 mm/sec (3 in/min). The magnitude of this force has been found to correlate with the tendency of the test fuel to cause sticking valves in vehicles. The results are set forth in Table 6 below.

Example B2

A sample fuel composition B2 was prepared by adding:

(1) 160 ppm by weight di-isodecyl phthalate ester, and (2) 160 ppma by weight of a hydrocarbyl amine having a 1300 MW polyisobutenyl moiety and an ethylene diamine moiety to the gasoline of Example B1.

The same experiment as in Example B1 was carried out using this fuel composition, and the results are shown in Table 6 below.

Example B3

A sample fuel composition B3 was prepared by adding:

(1) 160 ppm by weight of 420 number average molecular weight polyisobutene, and (2) 160 ppma by weight of a hydrocarbyl amine having a 1300 MW polyisobutenyl moiety and an ethylene diamine moiety to the gasoline of Example B1.

The same experiment as in Example B1 was carried out using this fuel composition, and the results are shown in Table 6 below.

Example B4

A sample fuel composition B4 was prepared by adding:

(1) 160 ppm by weight of 420 number average molecular weight polyisobutene; and (2) 160 ppm by weight di-isodecyl phthalate ester, and (3) 160 ppma by weight of a hydrocarbyl amine having a 1300 MW polyisobutenyl moiety and an ethylene diamine moiety to the gasoline of Example B1.

The same experiment as in Example B1 was carried out using this fuel composition, and the results are shown in Table 6 below.

TABLE 6

| Honda Generator Engine Test Results | | |
|---|---|---|
| | Force Required To Close Valves (newton) | |
| Test Fuel Detergent Package | Valve #1 | Valve #2 |
| Fuel Composition B2 | 51.6 | 88.9 |
| Fuel Composition B3 | 71.1 | 84.5 |
| Fuel Composition B4 | 1.3 | 29.8 |

The data in Table 6 illustrates the significant reduction in stickiness of the valves provided by the fuel composition of Example B4 as compared to the fuel compositions of Examples B2 and B3.

Example C

Fuel additive compositions of the present invention are also prepared which contain:

(1) 125 ppm by weight of 420 number average molecular weight polyisobutene;

(2) 125 ppm by weight di-isodecyl phthalate ester;

(3) 125 ppma by weight of a hydrocarbyl amine having a 1300 MW polyisobutenyl moiety and an ethylene diamine moiety;

and at least one of the following components:

(4) 125–250 ppm of a mineral oil carrier fluid; and/or (5) 10–50 ppm, preferably 20 ppm, of a low molecular weight hydrocarbyl amine carburetor or injector detergent, such as oleyl amine or polyisobutenyl (420 MW) ethylene diamine.

What is claimed is:

1. A fuel additive composition comprising:

(a) a fuel-soluble aliphatic hydrocarbyl-substituted amine having at least one basic nitrogen atom wherein the hydrocarbyl group has a number average molecular weight of about 700 to 3,000;

(b) a polyolefin polymer of a $C_2$ to $C_6$ monoolefin, wherein the polymer has a number average molecular weight of about 350 to 3,000; and (c) an aromatic di- or tri-carboxylic acid ester of the formula:

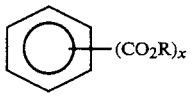

wherein R is an alkyl group of 4 to 20 carbon atoms, and x is 2 or 3.

2. The fuel additive composition according to claim 1, wherein the hydrocarbyl substituent on the aliphatic amine of component (a) has a number average molecular weight of about 750 to 2,200.

3. The fuel additive composition according to claim 2, wherein the hydrocarbyl substituent on the aliphatic amine of component (a) has a number average molecular weight of about 900 to 1,500.

4. The fuel additive composition according to claim 1, wherein the aliphatic amine of component (a) is a branched chain hydrocarbyl-substituted amine.

5. The fuel additive composition according to claim 4, wherein the aliphatic amine of component (a) is a polyisobutenyl amine.

6. The fuel additive composition according to claim 4, wherein the amine moiety of the aliphatic amine is derived from a polyamine having from 2 to 12 amine nitrogen atoms and from 2 to 40 carbon atoms.

7. The fuel additive composition according to claim 6, wherein the polyamine is a polyalkylene polyamine having 2 to 12 amine nitrogen atoms and 2 to 24 carbon atoms.

8. The fuel additive composition according to claim 7, wherein the polyalkylene polyamine is selected from the group consisting of ethylene diamine, diethylene triamine, triethylene tetramine and tetraethylene pentamine.

9. The fuel additive composition according to claim 8, wherein the polyalkylene polyamine is ethylene diamine or diethylene triamine.

10. The fuel additive composition according to claim 9, wherein the aliphatic amine of component (a) is a polyisobutenyl ethylene diamine.

11. The fuel additive composition according to claim 1, wherein the polyolefin polymer of component (b) is a polymer of a $C_2$ to $C_4$ monoolefin.

12. The fuel additive composition according to claim 11, wherein the polyolefin polymer of component (b) is polypropylene or polybutene.

13. The fuel additive composition according to claim 12, wherein the polyolefin polymer of component (b) is polyisobutene.

14. The fuel additive composition according to claim 1, wherein the polyolefin polymer of component (b) has a number average molecular weight of about 350 to 1500.

15. The fuel additive composition according to claim 14, wherein the polyolefin polymer of component (b) has a number average molecular weight of about 350 to 500.

16. The fuel additive composition according to claim 1, wherein the aromatic ester of component (c) is a phthalate, isophthalate or terephthalate ester.

17. The fuel additive composition according to claim 16, wherein the aromatic ester of component (c) is a phthalate ester.

18. The fuel additive composition according to claim 1, wherein the R group on the aromatic ester of component (c) is alkyl of 8 to 13 carbon atoms.

19. The fuel additive composition according to claim 1, wherein component (a) is a polyisobutenyl amine, wherein the amine moiety is derived from ethylene diamine or diethylene triamine, component (b) is polyisobutene, and component (c) is a phthalate ester.

20. A fuel composition comprising a major amount of hydrocarbons boiling in the gasoline or diesel range and an effective detergent amount of an additive composition comprising:

(a) a fuel-soluble aliphatic hydrocarbyl-substituted amine having at least one basic nitrogen atom wherein the hydrocarbyl group has a number average molecular weight of about 700 to 3,000;

(b) a polyolefin polymer of a $C_2$ to $C_6$ monoolefin, wherein the polymer has a number average molecular weight of about 350 to 3,000; and (c) an aromatic di- or tri-carboxylic acid ester of the formula:

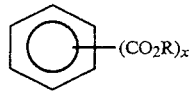

wherein R is an alkyl group of 4 to 20 carbon atoms, and x is 2 or 3.

21. The fuel composition according to claim 20, wherein the hydrocarbyl substituent on the aliphatic amine of component (a) has a number average molecular weight of about 750 to 2,200.

22. The fuel composition according to claim 21, wherein the hydrocarbyl substituent on the aliphatic amine of component (a) has a number average molecular weight of about 900 to 1,500.

23. The fuel composition according to claim 20, wherein the aliphatic amine of component (a) is a branched chain hydrocarbyl-substituted amine.

24. The fuel composition according to claim 23, wherein the aliphatic amine of component (a) is a polyisobutenyl amine.

25. The fuel composition according to claim 23, wherein the amine moiety of the aliphatic amine is derived from a polyamine having from 2 to 12 amine nitrogen atoms and from 2 to 40 carbon atoms.

26. The fuel composition according to claim 25, wherein the polyamine is a polyalkylene polyamine having 2 to 12 amine nitrogen atoms and 2 to 24 carbon atoms.

27. The fuel composition according to claim 26, wherein the polyalkylene polyamine is selected from the group consisting of ethylene diamine, diethylene triamine, triethylene tetramine and tetraethylene pentamine.

28. The fuel composition according to claim 27, wherein the polyalkylene polyamine is ethylene diamine or diethylene triamine.

29. The fuel composition according to claim 28, wherein the aliphatic amine of component (a) is a polyisobutenyl ethylene diamine.

30. The fuel composition according to claim 20, wherein the polyolefin polymer of component (b) is a polymer of a $C_2$ to $C_4$ monoolefin.

31. The fuel composition according to claim 30, wherein the polyolefin polymer of component (b) is polypropylene or polybutene.

32. The fuel composition according to claim 31, wherein the polyolefin polymer of component (b) is polyisobutene.

33. The fuel composition according to claim 20, wherein the polyolefin polymer of component (b) has a number average molecular weight of about 350 to 1500.

34. The fuel composition according to claim 33, wherein the polyolefin polymer of component (b) has a number average molecular weight of about 350 to 500.

35. The fuel composition according to claim 20, wherein the aromatic ester of component (c) is a phthalate, isophthalate or terephthalate ester.

36. The fuel composition according to claim 35, wherein the aromatic ester of component (c) is a phthalate ester.

37. The fuel composition according to claim 20, wherein the R group on the aromatic ester of component (c) is alkyl of 8 to 13 carbon atoms.

38. The fuel composition according to claim 20, wherein component (a) is a polyisobutenyl amine, wherein the amine moiety is derived from ethylene diamine or diethylene triamine, component (b) is polyisobutene, and component (c) is a phthalate ester.

39. A fuel concentrate comprising an inert stable oleophilic organic solvent boiling in the range of from about 150° F. to 400° F. and from about 10 to 90 weight percent of an additive composition comprising:

(a) a fuel-soluble aliphatic hydrocarbyl-substituted amine having at least one basic nitrogen atom wherein the hydrocarbyl group has a number average molecular weight of about 700 to 3,000;

(b) a polyolefin polymer of a $C_2$ to $C_6$ monoolefin, wherein the polymer has a number average molecular weight of about 350 to 3,000; and (c) an aromatic di- or tri-carboxylic acid ester of the formula:

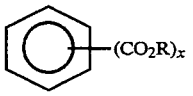

wherein R is an alkyl group of 4 to 20 carbon atoms, and x is 2 or 3.

40. The fuel concentrate according to claim 39, wherein the hydrocarbyl substituent on the aliphatic amine of component (a) has a number average molecular weight of about 750 to 2,200.

41. The fuel concentrate according to claim 40, wherein the hydrocarbyl substituent on the aliphatic amine of component (a) has a number average molecular weight of about 900 to 1,500.

42. The fuel concentrate according to claim 39, wherein the aliphatic amine of component (a) is a branched chain hydrocarbyl-substituted amine.

43. The fuel concentrate according to claim 42, wherein the aliphatic amine of component (a) is a polyisobutenyl amine.

44. The fuel concentrate according to claim 42, wherein the amine moiety of the aliphatic amine is derived from a polyamine having from 2 to 12 amine nitrogen atoms and from 2 to 40 carbon atoms.

45. The fuel concentrate according to claim 44, wherein the polyamine is a polyalkylene polyamine having 2 to 12 amine nitrogen atoms and 2 to 24 carbon atoms.

46. The fuel concentrate according to claim 45, wherein the polyalkylene polyamine is selected from the group consisting of ethylene diamine, diethylene triamine, triethylene tetramine and tetraethylene pentamine.

47. The fuel concentrate according to claim 46, wherein the polyalkylene polyamine is ethylene diamine or diethylene triamine.

48. The fuel concentrate according to claim 47, wherein the aliphatic amine of component (a) is a polyisobutenyl ethylene diamine.

49. The fuel concentrate according to claim 39, wherein the polyolefin polymer of component (b) is a polymer of a $C_2$ to $C_4$ monoolefin.

50. The fuel concentrate according to claim 49, wherein the polyolefin polymer of component (b) is polypropylene or polybutene.

51. The fuel concentrate according to claim 50, wherein the polyolefin polymer of component (b) is polyisobutene.

52. The fuel concentrate according to claim 39, wherein the polyolefin polymer of component (b) has a number average molecular weight of about 350 to 1500.

53. The fuel concentrate according to claim 52, wherein the polyolefin polymer of component (b) has a number average molecular weight of about 350 to 500.

54. The fuel concentrate according to claim 39, wherein the aromatic ester of component (c) is a phthalate, isophthalate or terephthalate ester.

55. The fuel concentrate according to claim 54, wherein the aromatic ester of component (c) is a phthalate ester.

56. The fuel concentrate according to claim 39, wherein the R group on the aromatic ester of component (c) is alkyl of 8 to 13 carbon atoms.

57. The fuel concentrate according to claim 39, wherein component (a) is a polyisobutenyl amine, wherein the amine moiety is derived from ethylene diamine or diethylene triamine, component (b) is polyisobutene, and component (c) is a phthalate ester.

* * * * *